United States Patent [19]

Kearn

[11] 4,091,466

[45] May 30, 1978

[54] HOCKEY GARMENT

[76] Inventor: Ronald Kearn, 146 N. Bonningten Ave., Scarborough, Ontario, Canada, M1K 1Y1

[21] Appl. No.: 756,806

[22] Filed: Jan. 5, 1977

[51] Int. Cl.[2] ..... A41D 13/00

[52] U.S. Cl. ..... 2/23; 2/24; 2/227; 2/409

[58] Field of Search ..... 2/2, 22, 23, 24, 83, 2/227, 404, 409, 236, 237

[56] References Cited

U.S. PATENT DOCUMENTS

| | | | |
|---|---|---|---|
| 759,765 | 5/1904 | Stall | 2/23 |
| 1,612,766 | 12/1926 | Levinson | 2/22 |
| 1,982,579 | 11/1934 | Earnshaw | 2/83 |
| 2,929,072 | 3/1960 | Heilbronner | 2/83 |
| 3,221,342 | 12/1965 | Payne | 2/83 |
| 3,670,339 | 6/1972 | Cooper et al. | 2/24 X |
| 3,787,892 | 1/1974 | Quinn | 2/2 |

FOREIGN PATENT DOCUMENTS

| | | | |
|---|---|---|---|
| 971,703 | 7/1975 | Canada | 2/23 |

*Primary Examiner*—Werner H. Schroeder
*Assistant Examiner*—Moshe I. Cohen
*Attorney, Agent, or Firm*—Peter Kent

[57] ABSTRACT

A unitary hockey garment formed of material comprising a body portion adapted to be snugly worn about the lower trunk area of the body and conforming to the contours thereof, with an integral crotch area associated with the body portion, and a pair of legs integrally connected to the body portion, each leg adapted to surround one leg of a wearer's body, and terminating in a foot portion connected to each of the leg portions adapted to surround the foot of the wearer. The foot portion includes an inner sock beneath the material of the garment, with a waist elastic band connected to the body portion at the upper end thereof, having crotch elastic bands extending from the crotch area to the waist elastic band, and an upper leg elastic band extending horizontally on each of the legs adjacent the crotch area, with a lower leg elastic band extending horizontally on each of the legs adjacent the foot portion, and a protective knee pad on each of the legs between the upper and lower elastic bands.

2 Claims, 3 Drawing Figures

HOCKEY GARMENT

BACKGROUND OF THE INVENTION

1. Field of the Invention

The present invention relates to sporting apparel, and more particularly to a one-piece unitary hockey garment.

2. Description of the Prior Art

One form of hockey garment is illustrated in U.S. Pat. No. 3,787,892. I have found that additional improvements are required to provide the end user with additional support, and in turn comfort, in the wearing of a garment of this sort. The advantages and distinctions of my invention over the prior art will become more clearly evident as the disclosure proceeds.

OBJECTS OF THE INVENTION

An object of the present invention is to provide a unitary hockey garment that provides additional comfort to the player and adapted to be worn about the lower trunk area and each foot portion.

Another object of the present invention is to provide a unitary hockey garment having elastic bands properly positioned thereon to provide the wearer with additional body support to aid in the garment's utilization.

Other objects and advantages of the present invention will become apparent as the disclosure proceeds.

SUMMARY OF THE INVENTION

A unitary hockey garment formed of material comprising a body portion adapted to be snugly worn about the lower trunk area of the body and conforming to the contours thereof, with an integral crotch area associated with the body portion, and a pair of legs integrally connected to the body portion, each leg adapted to surround one leg of a wearer's body, and terminating in a foot portion connected to each of the leg portions adapted to surround the foot of the wearer.

The foot portion includes an inner sock beneath the material of the garment, with a waist elastic band connected to the body portion at the upper end thereof, having crotch elastic bands extending from the crotch area to the waist elastic band, and an upper leg elastic band extending horizontally on each of the legs adjacent the crotch area, with a lower leg elastic band extending horizontally on each of the legs adjacent the foot portion, and a protective knee pad on each of the legs between the upper and lower elastic bands.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE DRAWINGS

Figure 2:
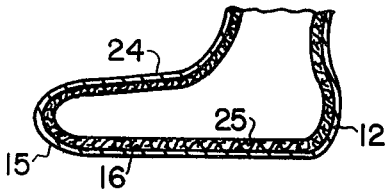
FIG. 2 is a sectional view taken along lines 2—2 of FIG. 1.
Figure 3:
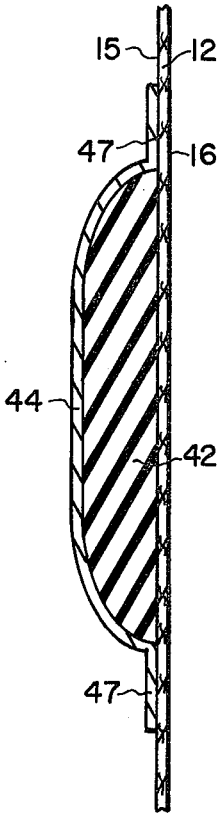
FIG. 3 is an enlarged sectional view taken along lines 3—3 of FIG. 1.
Figure 1:
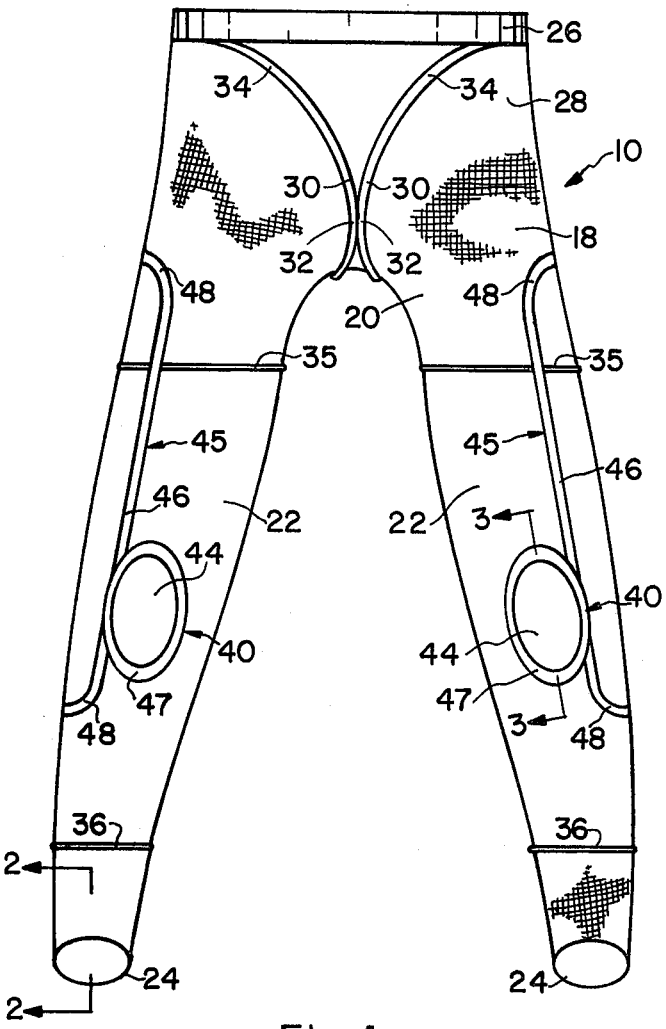
FIG. 1 is a front plan view of the hockey garment in accordance with the present invention.

Referring to the drawings, there is illustrated in FIGS. 1 through 3 a unitary hockey garment 10 formed of material 12 that may be woven, synthetic, etc., for use by an individual. The material 12 has an outer surface 15 and an inner surface 16. The garment 10 includes a body portion 18 adapted to be snugly worn about the lower trunk area of the body and conforming to the contours thereof with an integral crotch area 20 associated with the body portion 18.

A pair of legs 22 integrally connected to the body portion 18 is provided and each leg 15 is adapted to surround one leg of a wearer's body. A foot portion 24 is connected to each of the leg portions 22 adapted to surround the foot of the wearer. The foot portion 24 includes an inner sock 25 beneath the inner surface 16 of the material 12 of the garment 10. A waist elastic band 26 is connected to the body portion 18 at the upper end 28 thereof. Crotch elastic bands 30 extend from the crotch area 20 to the waist elastic band 26.

The crotch elastic bands 30 are joined substantially intermediate their ends 32 thereof adjacent the crotch area 20, and extend upwardly and outwardly therefrom for securement at their upper end 34 to the waist elastic band 26. The elastic bands 30 may be provided on both sides of the garment 10. The garment 10 includes an upper leg elastic band 35 extending horizontally on each of the legs 22 adjacent the crotch area 20, and a lower leg elastic band 36 extending horizontally on each of the legs 22 adjacent each foot portion 24.

A protective knee pad 40 is provided on each of the legs 22 between the upper and lower elastic bands 35 and 36, respectively. Each protective knee pad 40 includes a central portion 42 disposed against the material 12 of the garment 10, and a closure 44 surrounding the central portion 42 and peripherally secured to each leg 22.

The garment 10 further includes a vertical elastic band member 45 extending on each leg 22. The vertical elastic band member 45 includes a substantially straight section 46 extending from immediately adjacent the knee pad 40 to a point substantially even with the crotch area 20, and an outwardly extending curved section 48 at each end of the straight section 46. An elastic band 45 may be provided on each side of each leg 22. The straight section 46 extends in overlapping relationship with a portion of the knee pad 40 on each of the legs 22. The straight section 46 may overlap the rim section 47 of the closure 44. The straight section 46 crosses the upper elastic band 35 and may be wider than the bands 35 and 36.

The elastic material utilized in the garment 10 may be secured thereto as by stitching and has been positioned in such a manner as to provide to the user the necessary support and at the same time maintain the garment in gripping relationship to the body surface of the wearer, or if desired, conventional underwear may also be employed should it be desired. The garment 10 has the necessary contour and may be worn by an athlete while playing hockey on outdoor arenas or rinks, as well as indoors. Other players in other sports may also wear the garment illustrated herein although it has been referred to as ideally suited for hockey.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

I claim:

1. A unitary hockey garment formed of material comprising;

a. a body portion adapted to be snugly worn about the lower trunk area of the body and conforming to the contours thereof, b. an integral crotch area associated with said body portion, c. a pair of legs integrally connected to said body portion, each said leg adapted to surround one leg of the wearer, d. a foot portion connected to each of said leg portions adapted to surround the foot of the wearer, e. said foot portion including an inner sock beneath said material of the garment.

f. a waist elastic band connected to said body portion at the upper end thereof, g. crotch elastic bands secured along their length to said body portion and extending from said crotch area to said waist elastic band, h. said crotch elastic bands are joined to each other intermediate the ends thereof adjacent said crotch area, and extending upwardly therefrom and secured to said waist elastic band, i. an upper leg elastic band extending circumferentially and horizontally on each of said legs adjacent said crotch area, j. a lower leg elastic band extending circumferentially and horizontally on each of said legs adjacent said foot portion, k. a protective knee pad on each of said legs between said upper and lower elastic bands, l. a vertical elastic band member extending on the outside of each said leg and comprising:

(1) a substantially straight section extending from immediately adjacent said knee pad to a point substantially even with said crotch area, (2) an outwardly extending curved section at each end of said straight section, (3) said straight section extends in overlapping relationship with a portion of said knee pad on each of said legs, and (4) said straight section crosses said upper elastic band, and m. said elastic bands being positioned in such a manner to provide the garment with the necessary support and concurrently maintain the garment in gripping relationship to the body surface of the wearer.

2. A garment as in claim 1, wherein each said protective knee pad includes:

a. a central portion disposed against the material of the garment, and b. a closure surrounding said central portion and peripherally secured to said leg.

* * * * *